US006106339A

United States Patent [19]

Nagai

[11] Patent Number: 6,106,339

[45] Date of Patent: Aug. 22, 2000

[54] CONNECTION TERMINAL HAVING A RETAINING PORTION FOR RECEIVING A RETAINING FORCE

[75] Inventor: Kentaro Nagai, Shizuoka, Japan

[73] Assignee: Yazaki Corporation, Tokyo, Japan

[21] Appl. No.: 09/131,885

[22] Filed: Aug. 10, 1998

[30] Foreign Application Priority Data

Aug. 8, 1997 [JP] Japan ..... 9-215084

[51] Int. Cl.[7] ..... H01R 13/432

[52] U.S. Cl. ..... 439/748; 439/744

[58] Field of Search ..... 439/744, 748, 439/746, 749

[56] References Cited

U.S. PATENT DOCUMENTS

| | | | |
|---|---|---|---|
| 3,783,440 | 1/1974 | Karube et al. | 339/217 |
| 4,458,971 | 7/1984 | D'urso et al. | 339/74 |
| 5,489,223 | 2/1996 | Faje et al. | 439/748 |
| 5,624,273 | 4/1997 | Myer | 439/399 |
| 5,695,368 | 12/1997 | Joly et al. | 439/748 |
| 5,741,162 | 4/1998 | Kourimsky et al. | 439/748 |
| 5,899,775 | 5/1999 | Davis et al. | 439/748 |
| 5,911,603 | 6/1999 | Mansutti | 439/748 |

FOREIGN PATENT DOCUMENTS

| | | | |
|---|---|---|---|
| 8-6374 | 2/1996 | Japan | H01R 13/42 |

*Primary Examiner*—Paula Bradley
*Assistant Examiner*—Truc Nguyen
*Attorney, Agent, or Firm*—Sughrue, Mion, Zinn, Macpeak & Seas, PLLC

[57] ABSTRACT

A connection terminal which is adapted to be secured to an end of a wiring cord, and is adapted to be inserted and retained in a housing of a connector against withdrawal. The connection terminal includes a terminal body having a lance formed thereon by stamping. At least one of opposite side edge portions of the lance is bent to form a retaining portion, and a curl prevention portion is formed on that portion of the terminal body disposed rearwardly of a free end of the lance. That is, the curl prevention portion is formed by bending part of the terminal body, so that the curl prevention portion is opposed to a substantially entire surface of the free end of the lance.

6 Claims, 3 Drawing Sheets

CONNECTION TERMINAL HAVING A RETAINING PORTION FOR RECEIVING A RETAINING FORCE

BACKGROUND OF THE INVENTION

1. Field of the Invention

This invention relates to a connection terminal which is adapted to be secured to an end of a wiring cord, and is adapted to be inserted and retained in a housing of a connector against withdrawal.

2. Description of the Related Art

One known connection terminal of the type described above is shown in FIGS. 3 and 4. As shown in FIG. 3, this connection terminal 1 is of the female type, and includes a terminal body 2 of an elongate, substantially box-like shape. A lance 3 is formed by stamping at a front portion of an upper surface (or wall) 2*a* of the terminal body 2, and when the terminal 1 is inserted into a housing of a connector (not shown), this lance 3 is engaged with a portion of the housing so as to retain the terminal 1 against withdrawal. As shown in FIGS. 3 and 4, the lance 3 is supported on the terminal body 2 in a cantilever manner, and is slanting upwardly toward a rear end of the terminal body, and a free or distal end 3*a* of the lance 3 is projected beyond the upper surface 2*a* of the terminal body 2. A technique analogous to this connection terminal 1 is disclosed in Japanese Utility Model Examined Publication No. Hei. 8-6374.

However, this conventional connection terminal 1 has a drawback that when an external force F is applied to the lance 3 from the rear side as shown in FIG. 4, the lance 3 is curled or turned up and plastically deformed as indicated by a broken line in FIG. 4.

SUMMARY OF THE INVENTION

With the above problem in view, it is an object of this invention to provide a connection terminal in which the curling of a lance is prevented as much as possible, thereby positively preventing the plastic deformation of the lance.

In order to achieve the above object, according to the present invention, there is provided a connection terminal comprising: a terminal body; a lance formed on the terminal body by stamping; a retaining portion formed by bending at least one of opposite side edge portions of the lance; and a curl prevention portion formed on a portion of the terminal body disposed rearwardly of a free end of the lance.

BRIEF DESCRIPTION OF THE DRAWINGS

FIG. 2(*b*) is a cross-sectional view of an important portion of a conventional connection terminal;

DETAILED DESCRIPTION OF THE PREFERRED EMBODIMENT

A preferred embodiment of the present invention will now be described with reference to the drawings.

Figure 1:
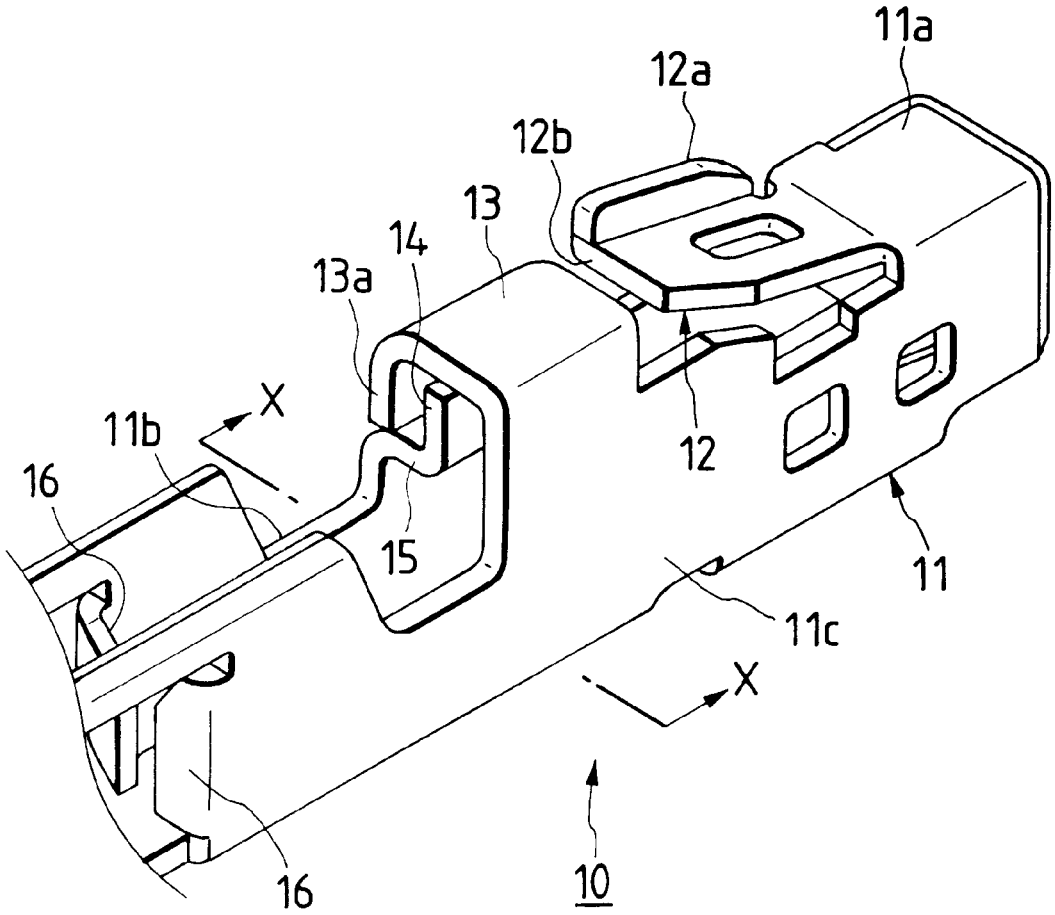
FIG. 1 is a perspective view of a portion of a preferred embodiment of a connection terminal of the present invention.
Figure 2A:
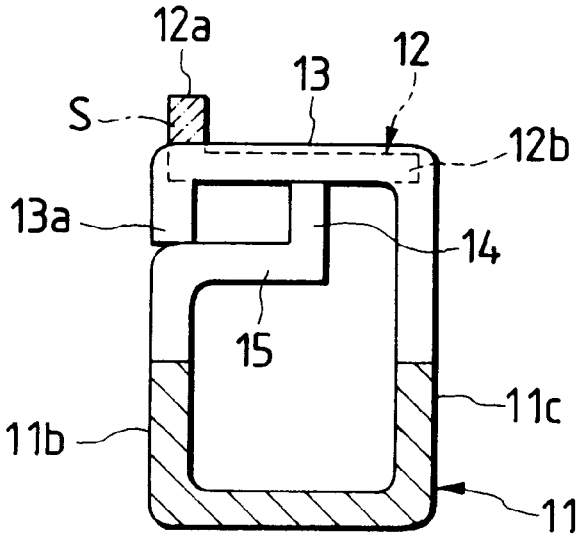
FIG. 2(*a*) is a cross-sectional view taken along the line X—X of FIG. 1.
Figure 2B:
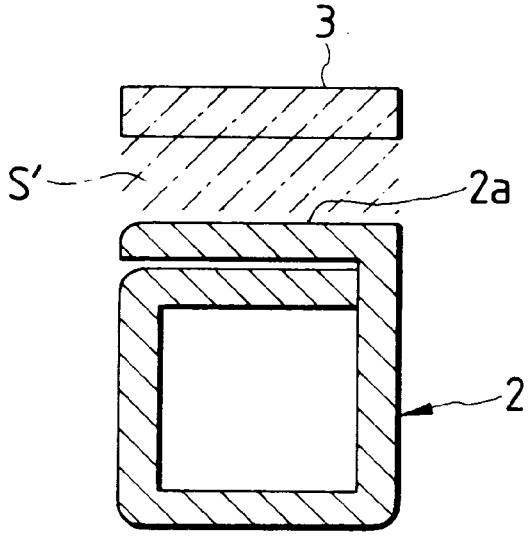
FIG. 2(b) PRIOR ART
Figure 3:
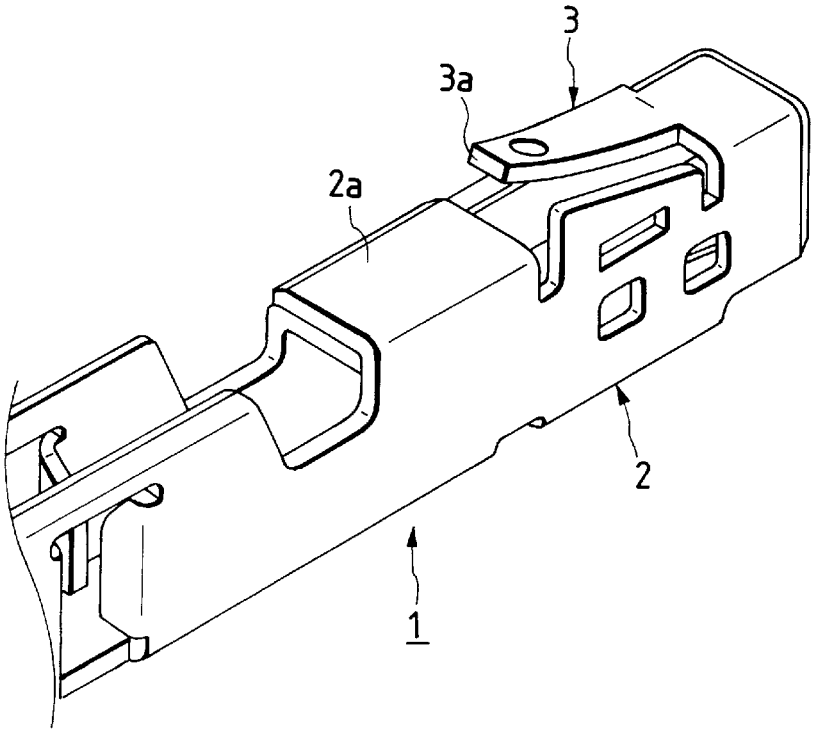
FIG. 3 PRIOR ART
FIG. 3 is a perspective view of a portion of a conventional connection terminal.
Figure 4:
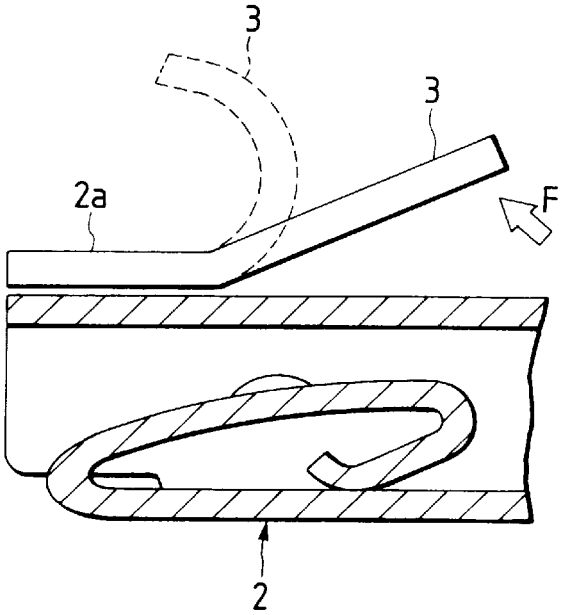
FIG. 4 PRIOR ART
FIG. 4 is an enlarged, cross-sectional view of the conventional connection terminal.

FIG. 1 is a perspective view of a portion of the preferred embodiment of a connection terminal of the invention, and FIG. 2(*a*) is a cross-sectional view taken along the line X—X of FIG. 1.

As shown in FIG. 1, the connection terminal 10 is of the female type, and its terminal body 11, having an elongate, substantially box-like shape, is formed by bending a metal sheet into a substantially square tubular shape. A lance 12 is formed by stamping at a front portion of an upper wall 11*a* of the terminal body 11, and when the terminal 10 is inserted into a housing of a connector (not shown), this lance 12 is engaged with a portion of the housing so as to retain the terminal 10 against withdrawal. The lance 12 is supported on the upper wall 11*a* of the terminal body 11 in a cantilever manner, and is slanting upwardly toward a rear end of the terminal body, and one side edge portion (left side edge portion in the drawing) of the lance 12 is perpendicularly bent to form a projected retaining portion 12*a*.

As shown in FIGS. 1 and 2(*a*), a curl prevention portion 13 is formed on that portion of the upper wall 11*a* of the terminal body 11 disposed rearwardly of a free end 12*b* of the lance 12. More specifically, the curl prevention portion 13 is formed by bending part of the upper wall 11*a* of the terminal body 11 (that is, part of a right side wall 11*c* in the drawing) into an inverted U-shape, and this curl prevention portion 13 of an inverted U-shape is projected upwardly, and is opposed to a substantially entire surface of the free end 12*b* of the lance 12, and is spaced a predetermined distance (clearance) from the free end 12*b*. Part of a left side wall 11*b* of the terminal body 11 is bent into an L-shape to provide an upstanding piece portion 14, and a central portion of a lower surface of a top wall of the curl prevention portion 13 rests on an upper end or edge of the upstanding piece portion 14. A distal end 13*a* of the curl prevention portion 13 is held against a horizontal portion 15 of the L-shaped portion of the left side wall 11*b*. With this construction, the curl prevention portion 13 is prevented from being deformed downwardly.

As shown in FIG. 1, a pair of front press-connecting blades 16 and 16, as well as a pair of rear press-connecting blades (not shown), are formed by stamping respectively on opposed rear portions of the left and right side walls 11*b* and 11*c* of the terminal body 11. An end portion of a wiring cord (not shown) is press-connected to these press-connecting blades 16.

In the connection terminal 10 of this embodiment, the curl prevention portion 13 is formed on that portion of the upper wall 11*a* of the terminal body 11, disposed rearwardly of the free end 12*b* of the lance 12, in such a manner that the free end 12*b* of the lance 12 is not projected outwardly beyond the curl prevention portion 13, as shown in FIG. 1. Therefore, an area S of that portion of the lance 12, which projects outwardly beyond the curl prevention portion 13, and can undergo an external force tending to curl the lance 12, is only the area of the free end of the retaining portion 12*a* of the lance 12, as shown in FIG. 2(*a*). This area S is much smaller than an area S' (see FIG. 2(*b*)) of that portion of the conventional lance which can undergo an external force tending to curl the lance ($S<S'$).

Thus, the area of that portion of the lance, which can undergo an external force tending to curl the lance, is greatly reduced, and therefore the curling of the lance 12 by an external force can be prevented as much as possible, so that the lance 12 can be positively prevented from being plastically deformed. As a result, the lance 12 is always kept in a resiliently-deformable condition, and therefore can retain the withdrawal prevention function.

In the above embodiment, although only one side edge portion of the lance is bent to form the retaining portion, the opposite side edge portions may be bent to form two retaining portions.

As described above, that portion of the lance, projecting outwardly beyond the curl prevention portion, is only the retaining portion of the lance, and therefore even when an external force is applied to the lance from the free end side thereof, the curling of the lance is prevented as much as possible, and the lance is positively prevented from being plastically deformed.

What is claimed is:

1. A connection terminal comprising:

a terminal body;

a lance formed on said terminal body by stamping;

a retaining portion for receiving a retaining force, said retaining portion defined by a bent portion formed from at least one of opposite side edge portions of said lance; and a curl prevention portion formed on a portion of said terminal body disposed rearwardly of a free end of said lance.

2. The connection terminal according to claim 1, wherein said curl prevention portion is formed by bending part of said terminal body, so that said curl prevention portion is opposed to a substantially entire surface of the free end of said lance.

3. The connection terminal according to claim 2, wherein part of a left side wall of said terminal body is bent into an L-shape to provide an upstanding piece portion, and a central portion of a lower surface of a top wall of said curl prevention portion rests on an upper end of the upstanding piece portion, and wherein a distal end of said curl prevention portion is held against a horizontal portion of the L-shaped portion of the left side wall.

4. The connection terminal of claim 1, wherein said retaining portion is substantially perpendicular to said lance.

5. The connection terminal of claim 1, wherein said free end of said lance has a surface area which is greater than a surface area of an end of said retaining portion.

6. A connection terminal comprising:

a terminal body;

a lance formed on said terminal body by stamping, said lance having a free end;

a retaining portion defined by a bent portion formed from at least one of opposite side edge portions of said lance; and a curl prevention portion formed on a portion of said terminal body disposed rearwardly of said free end of said lance, wherein said curl prevention portion is defined by a bent portion of said terminal body, so that said curl prevention portion is substantially planar with said free end of said lance for reducing an area which receives a retaining force.

* * * * *